US009514689B2

(12) United States Patent
Lee et al.

(10) Patent No.: US 9,514,689 B2
(45) Date of Patent: Dec. 6, 2016

(54) DISPLAY DEVICE

(71) Applicant: Samsung Display Co., Ltd., Yongin, Gyeonggi-Do (KR)

(72) Inventors: Seok Hwan Lee, Seoul (KR); Seung Young Choi, Yongin-si (KR); Byung Kyou Min, Seoul (KR); Dae Sik Lee, Asan-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 80 days.

(21) Appl. No.: 14/643,465

(22) Filed: Mar. 10, 2015

(65) Prior Publication Data

US 2016/0078821 A1 Mar. 17, 2016

(30) Foreign Application Priority Data

Sep. 15, 2014 (KR) ..... 10-2014-0122204

(51) Int. Cl.
*G09G 3/34* (2006.01)

(52) U.S. Cl.
CPC ..... *G09G 3/3406* (2013.01); *G09G 3/3426* (2013.01); *G09G 2320/0247* (2013.01); *G09G 2320/062* (2013.01); *G09G 2320/0626* (2013.01); *G09G 2320/0646* (2013.01); *G09G 2360/16* (2013.01)

(58) Field of Classification Search
CPC combination set(s) only.
See application file for complete search history.

(56) References Cited

U.S. PATENT DOCUMENTS

2011/0316449 A1* 12/2011 Imanaka ..... H05B 41/2828 315/307
2013/0114016 A1 5/2013 Lim et al.
2015/0084541 A1* 3/2015 Jung ..... H05B 33/0815 315/291

FOREIGN PATENT DOCUMENTS

KR 10-2005-0120901 A 12/2005
KR 10-2011-0071429 A 6/2011
KR 10-2013-0050509 A 5/2013
KR 10-2013-0106033 A 9/2013
KR 10-2014-0047200 A 4/2014

* cited by examiner

*Primary Examiner* — Van Chow
(74) *Attorney, Agent, or Firm* — Robert E. Bushnell, Esq.

(57) ABSTRACT

A display device includes at least one light source array configured to provide a display panel with light, a dimming signal generating unit configured to receive an image data signal and generate a dimming signal, a first comparator configured to receive the dimming signal output from the dimming signal generating unit and a preset critical value and generate a comparison signal, a dimming modulating unit configured to receive the comparison signal output from the first comparator and the dimming signal output from the dimming signal generating unit and modulate the dimming signal, a constant current controller configured to receive the dimming signal output from the dimming modulating unit and a voltage from a sensor node, and to control a light driving current driving the light source array, and a resistor controller configured to change resistors connected to the sensor node by the comparison signal output from the first comparator.

13 Claims, 9 Drawing Sheets

DISPLAY DEVICE

This application claims priority to Korean Patent Application No. 10-2014-0122204, filed on Sep. 15, 2014, and all the benefits accruing therefrom under 35 U.S.C. §119, the content of which is incorporated herein in its entirety by reference.

BACKGROUND OF THE INVENTION

Field of the Invention

Exemplary embodiments of the invention relate to a display device in which a light source is normally driven even when a level of a dimming signal is very low.

Description of the Related Art

A liquid crystal display (LCD) utilizes a liquid crystal that is a non-emitting element, and thus requires a backlight unit that produces light.

The backlight unit includes a plurality of light source arrays including a number of light emitting diodes.

The backlight unit is controlled by a dimming method for improvement in image quality.

The dimming method is broadly categorized into an analog dimming method and a digital dimming method. The analog dimming method controls light intensity by linearly adjusting a light driving current supplied to a light emitting diode. The digital dimming method controls light intensity by adjusting a light driving current by a duty ratio of a digital pulse signal.

A display device with a backlight unit of the analog dimming method adjusts a dimming signal according to luminance of an image so as to control brightness of the backlight unit. For instance, the display device increases a level of the dimming signal when an image having a high luminance is displayed, and on the other hand it decreases a level of the dimming signal when an image with a low luminance is displayed.

When an image with a very low luminance is displayed, the level of the dimming signal needs to be considerably lowered, and then it causes the following problems.

Where the dimming signal has a very low level, an integrated circuit that processes the dimming signal fails to recognize (or detect) the dimming signal, and a light emitting diode fails to be turned on or a flicker of the light emitting diode occurs.

Accordingly, a display device using the conventional analog dimming method has a disadvantage that cannot normally display an image having a very low luminance.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding effective filing dates of subject matter disclosed herein.

SUMMARY OF THE INVENTION

One or more exemplary embodiment of the invention is directed toward a display device capable of normally displaying an image with a very low luminance, wherein a light source of the display device is normally driven even when a level of a dimming signal is very low.

According to an exemplary embodiment of the invention, a display device includes at least one light source array configured to provide a display panel with light, a dimming signal generating unit configured to receive an image data signal and generate a dimming signal, a first comparator configured to receive the dimming signal output from the dimming signal generating unit and a preset critical value and generate a comparison signal, a dimming modulating unit configured to receive the comparison signal output from the first comparator and the dimming signal output from the dimming signal generating unit and modulate the dimming signal, a constant current controller configured to receive the dimming signal output from the dimming modulating unit and a voltage of a sensor node, and to control a light driving current allowing the light source array to drive, and a resistor controller configured to change resistors connected to the sensor node by the comparison signal output from the first comparator.

The dimming modulating unit may include a modulator including an output terminal connected to the constant current controller, a first switching element controlled according to the comparison signal output from the first comparator and connected between an output terminal of the dimming signal generating unit and the output terminal of the modulator, and a second switching element controlled according to the comparison signal output from the first comparator and connected between the output terminal of the dimming signal generating unit and an input terminal of the modulator.

When the comparison signal output from the first comparator is in a first logic state, the first switching element may output a substantially the same signal as the dimming signal to the output terminal of the modulator, and when the comparison signal output from the first comparator is in a second logic state, the second switching element may output a substantially the same signal as the dimming signal to the input terminal of the modulator.

The modulator may be used as an amplifier that amplifies the dimming signal input to the modulator through the second switching element.

The display device may further include first and second resistors connected in parallel between a driving power and the output terminal of the dimming signal generating unit.

The resistor controller may include sensor resistors connected in series between the sensor node and a ground, and a switching element controlled according to the comparison signal output from the first comparator and connected between any one of connecting points between the sensor resistors and the sensor node.

When the comparison signal output from the first comparator is in the first logic state, the switching element may short circuit the sensor node and the connecting points.

The sensor resistors may include at least two resistors having different resistance values.

The resistor controller may include a variable resistor connected between the sensor node and the ground, and an adjustment unit configured to adjust a resistance value of the variable resistor according to the comparison signal output from the first comparator.

The variable resistor may be a digital variable resistor.

The constant current controller may include a second comparator configured to receive the dimming signal output from the dimming modulating unit and a sense voltage of the sensor node and generate a comparison signal, and a constant current switching element controlled according to the comparison signal output from the second comparator and connected between the light source array and the sensor node.

The dimming signal generating unit may include a pulse width modulator configured to externally receive an image data signal and generate a pulse width modulation signal, and a filter unit configured to receive the pulse width modulation signal from the pulse width modulator and generate a dimming signal so as to provide the first comparator with the dimming signal.

The light source array may include at least one light emitting element.

According to one or more exemplary embodiment of the invention, a display device achieves the following effects.

The display device may amplify a dimming signal when a level of the dimming signal is less than a critical value and may increase a resistance value by the amplification rate so as to reduce or effectively prevent an increase in a light driving current. Therefore, a constant current switching element may be normally operated by the amplified dimming signal and also sensor resistors may increase with the amplification rate of the dimming signal, thereby normally generating a light driving current with a level corresponding to the original dimming signal (the dimming signal before being amplified). Consequently, even an image having very low luminance may be displayed in an ordinary manner.

The foregoing summary is illustrative only and is not intended to be in any way limiting the claims of the invention. In addition to the illustrative embodiments and features described above, further embodiments and features will become apparent by reference to the drawings and the following detailed description.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings, in which like reference symbols indicate the same or similar components, wherein.

DETAILED DESCRIPTION

Figure 1:
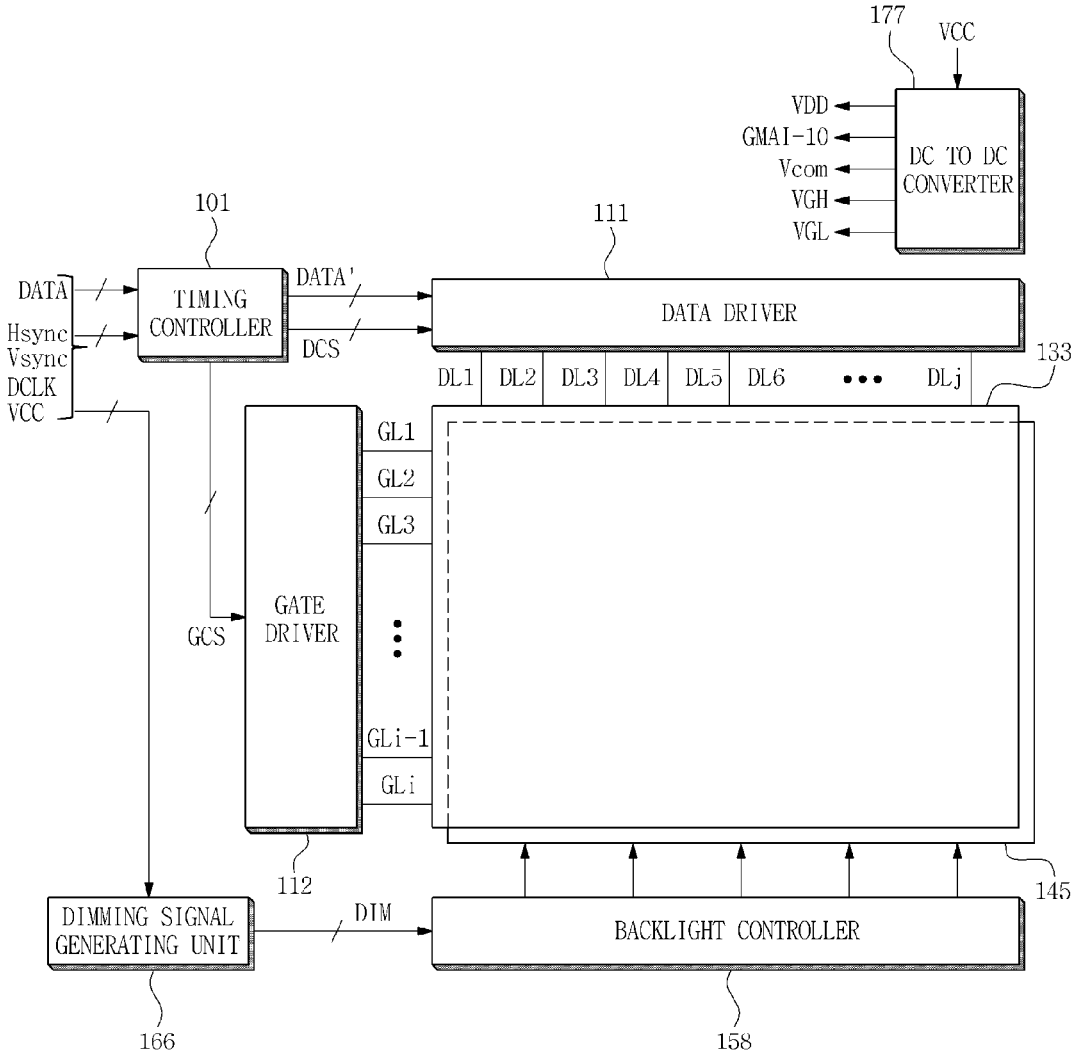
FIG. 1 is a block configuration diagram illustrating a display device according to an exemplary embodiment of the invention.

Advantages and features of the present invention and methods for achieving them will be made clear from embodiments described below in detail with reference to the accompanying drawings. The present invention may, however, be embodied in many different forms and should not be construed as limited to the embodiments set forth herein. Rather, these embodiments are provided so that this disclosure will be thorough and complete, and will fully convey the scope of the invention to those skilled in the art. This invention will be defined only by the scope of the claims. Therefore, well-known constituent elements, operations and techniques are not described in detail in the embodiments, to prevent the present invention from being obscurely interpreted. Like reference numerals refer to like elements throughout the specification.

Spatially relative terms, such as "below," "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "lower" relative to other elements or features would then be oriented "above" or "upper" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

In the specification, when a first element is referred to as being "connected" to a second element, the first element may be directly connected to the second element or indirectly connected to the second element with one or more intervening elements interposed therebetween. The terms "comprises," "comprising," "includes," and/or "including," when used in this specification, may specify the presence of stated features, integers, steps, operations, elements, and/or components, but do not preclude the presence or addition of one or more other features, integers, steps, operations, elements, and/or components.

Although the terms "first," "second," and "third" and the like may be used herein to describe various elements, these elements should not be limited by these terms. These terms may be used to distinguish one element from another element. Thus, "a first element" could be termed "a second element" or "a third element," and "a second element" and "a third element" can be termed likewise without departing from the teachings herein. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively.

Unless otherwise defined, all terms including technical and scientific terms used herein have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present application.

Figure 2:
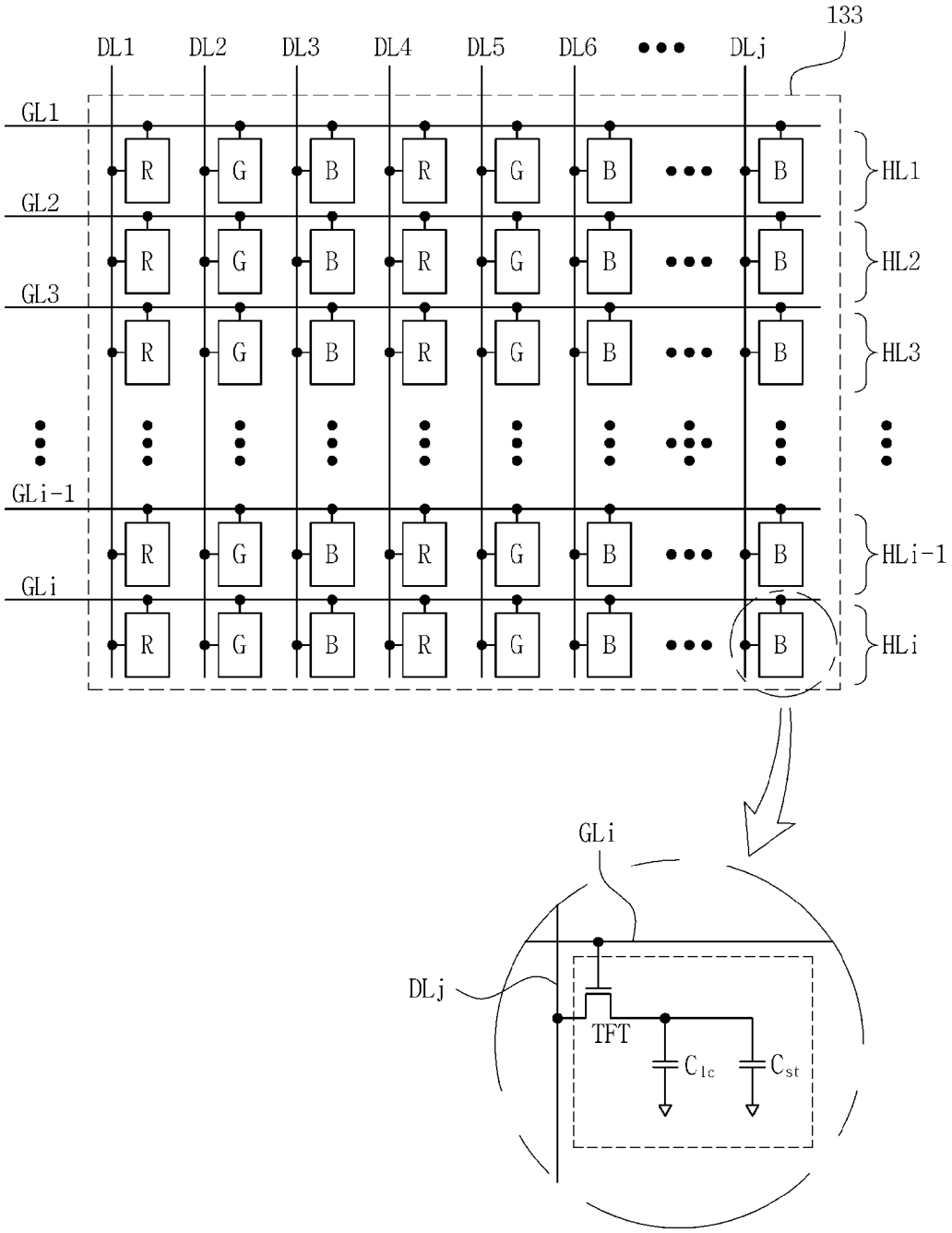
FIG. 2 is a detailed configuration diagram illustrating a display panel shown in FIG. 1.
Figure 3:
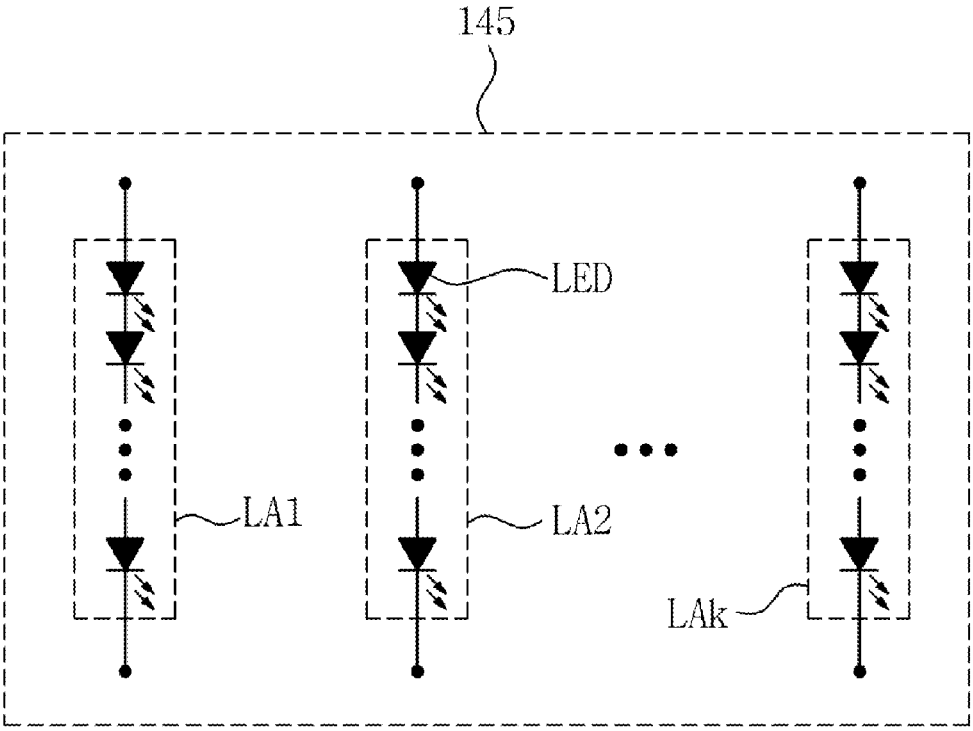
FIG. 3 is a detailed configuration diagram illustrating a backlight unit shown in FIG. 1.

FIG. 1 is a block configuration diagram illustrating a display device according to an exemplary embodiment of the invention. FIG. 2 is a detailed configuration diagram illustrating a display panel shown in FIG. 1. FIG. 3 is a detailed configuration diagram illustrating a backlight unit shown in FIG. 1.

As illustrated in FIG. 1, the display device may include a display panel 133, a backlight unit 145, a backlight controller 158, a dimming signal generating unit 166, a timing controller 101, a gate driver 112, a data driver 111, and a DC to DC converter 177.

The display panel 133 may be configured to display an image. Although not illustrated, the display panel 133 may include a liquid crystal layer, and a lower substrate and an upper substrate that oppose each other with the liquid crystal layer interposed therebetween.

A plurality of gate lines (GL1 to GLi), a plurality of data lines (DL1 to DLj) that intersect (or cross) the plurality of gate lines (GL1 to GLi), and thin film transistors (TFTs) that are connected to the plurality of gate lines (GL1 to GLi) and the plurality of data lines (DL1 to DLj) may be disposed on the lower substrate.

Although not illustrated, a black matrix, a plurality of color filters, and a common electrode may be disposed on the upper substrate. The black matrix may be disposed in an area except for parts corresponding to pixel areas of the upper substrate. The color filters may be disposed in the pixel areas. The color filters may be classified into a red color filter, a green color filter, and a blue color filter.

Pixels (R, G, and B) may be arranged in a matrix form, as shown in FIG. 2. The pixels (R, G, and B) may be classified into three categories: a plurality of red pixels (R) disposed corresponding to the red color filter; a plurality of green pixels (G) disposed corresponding to the green color filter; and a plurality of blue pixels (B) disposed corresponding to the blue color filter. The red, green, and blue pixels (R, G, and B), which are adjacent to each other in a horizontal direction, may form a unit pixel that displays a combination of colors.

J (j is a natural number) pixels (hereinafter referred to as "$n^{th}$ horizontal line pixels") disposed along an $n^{th}$ horizontal line, where n is any one selected from 1 to i, may be connected to $1^{th}$ to $j^{th}$ data lines (DL1 to DLj), respectively. The $n^{th}$ horizontal line pixels may be connected in common to an $n^{th}$ gate line. Accordingly, the $n^{th}$ horizontal line pixels may receive in common an $n^{th}$ gate signal. That is, the j pixels disposed on the same horizontal line may be all supplied with the same gate signal, but pixels on different horizontal lines may be supplied with different gate signals. In an exemplary embodiment, red and green pixels R and G disposed on a first horizontal line HL1 may be all supplied with a first gate signal, whereas red and green pixels R and G disposed on a second horizontal line HL2 may be supplied with a second gate signal that has a different timing from the first gate signal.

As illustrated in FIG. 2, the respective pixels (R, G, and B) may include a thin film transistor ("TFT"), a liquid crystal capacitor $C_{LC}$, and a storage capacitor $C_{st}$.

The TFT may be turned on according to gate signal transmitted through the gate line GLi. The TFT that is turned on may provide the liquid crystal capacitor $C_{lc}$ and the storage capacitor $C_{st}$ with analog image data signals transmitted through the data line DLj.

The liquid crystal capacitor $C_{LC}$ may include a pixel electrode and a common electrode that oppose each other.

The storage capacitor $C_{st}$ may include a pixel electrode and a counter electrode that oppose each other. The counter electrode may be a previous gate line or a common line that transmits a common voltage.

Meanwhile, among the components of the pixels (R, G, and B), the TFT may be covered with the black matrix.

The timing controller 101 may receive a vertical synchronization signal Vsync, a horizontal synchronization signal Hsync, an image data signal DATA, and a clock signal DCLK, which are output from a graphic controller of a system. An interface circuit (not shown) may be disposed between the timing controller 101 and the system, and thus the signals output from the system may be input to the timing controller 101 through the interface circuit. The interface circuit may be built in the timing controller 101.

Although not illustrated, the interface circuit may include an LVDS receiver. The interface circuit may lower voltage levels of the vertical synchronization signal Vsync, the horizontal synchronization signal Hsync, the image data signal DATA, and the clock signal DCLK, which are output from the system, while it may raise frequencies of the signals.

Meanwhile, electromagnetic interference ("EMI") may occur between the interface circuit and the timing controller 101 due to a high-frequency component of the signals input from the interface circuit to the timing controller 101. In order to reduce or effectively prevent the electromagnetic interference, an EMI filter (not shown) may be further disposed between the interface circuit and the timing controller 101.

The timing controller 101 may generate a gate control signal GCS and a data control signal DCS that control the gate driver 112 and the data driver 111, respectively, utilizing the vertical synchronization signal Vsync, the horizontal synchronization signal Hsync, and the clock signal DCLK. The gate control signal may include a gate start pulse, a gate shift clock, a gate output enable, and the like. The data control signal may include a source start pulse, a source shift clock, a source output enable, a polarity signal, and the like.

Further, the timing controller 101 may rearrange the image data signals DATA output from the system and may provide the data driver 111 with the rearranged image data signals DATA'.

Meanwhile, the timing controller 101 may be operated by a driving power VCC output from a power supply unit included in the system, and particularly the driving power VCC may be used as a power supply voltage of a phase lock loop ("PLL") installed in the timing controller 101. The PLL may compare the clock signal DCLK input to the timing controller 101 with a reference frequency generated by an oscillator. As a result of the comparison, where there is an error between the clock signal DCLK and the reference frequency, the PLL may adjust a frequency of the clock signal DCLK according to the error so as to generate a sampling clock signal. The sampling clock signal may be a signal that samples the image data signals DATA'.

The DC to DC converter 177 may increase or decrease a voltage of the driving power VCC input from the system so as to produce voltages required for the display panel 133. For this purpose, the DC to DC converter 177 may include, for example, an output switching element configured to switch an output voltage of an output terminal of the DC to DC converter 177 and a pulse width modulator configured to increase or decrease the output voltage by controlling a duty ratio or frequency of a control signal applied to a control terminal of the output switching element. In this case, the DC to DC converter 177 may include a pulse frequency modulator instead of the pulse width modulator.

The pulse width modulator may increase a duty ratio of the control signal so as to raise the output voltage of the DC to DC converter 177 or may decrease the duty ratio of the control signal so as to lower the output voltage of the DC to DC converter 177. The pulse frequency modulator may increase a frequency of the control signal so as to raise the output voltage of the DC to DC converter 177 or may decrease the frequency of the control signal so as to lower the output voltage of the DC to DC converter 177. The output voltage of the DC to DC converter 177 may include a reference voltage VDD of 6[V] or more, a gamma reference voltage (GMA1~GMA10) of less than level 10, a common voltage Vcom in a range of 2.5V to 3.3V, a gate high voltage VGH of 15[V] or more, and a gate low voltage VGL of −4[V] or less.

The gamma reference voltage (GMA1~GMA10) may be generated by division of the reference voltage VDD. The reference voltage VDD and the gamma reference voltage may be an analog gamma voltage and may be supplied to data driver integrated circuits D-ICs. The common voltage Vcom may be supplied to a common electrode of the display panel 133 via the data driver integrated circuits D-ICs. The gate high voltage VGH may be a high logic level voltage of a gate signal that is set to be greater than a threshold voltage of the TFT. The gate low voltage may be a low logic level voltage of a gate signal that is set to an off voltage of the TFT. The gate high and low voltages VGH and VGL may be supplied to the gate driver 112.

The gate driver 112 may generate gate signals according to the gate control signal GCS supplied from the timing controller 101 and may transmit the gate signals sequentially to a plurality of gate lines (GL1 to GLi). In an exemplary embodiment, the gate driver 112 may include a shift register that shifts a gate start pulse in accordance with a gate shift clock and generates the gate signals. The shift register may include a plurality of switching elements. The switching elements may be disposed on a front surface of the lower substrate by the same process as the TFT of a display area.

The data driver 111 may receive the image data signals DATA' and the data control signal DCS from the timing controller 101. The data driver 111 may sample the image data signals DATA' according to the data control signal DCS and may then latch the sample image data signals falling into one horizontal line every horizontal time, and may supply the latched image data signals to the data lines (DL1 to DLj). In other words, the data driver 111 may convert the image data signals DATA' from the timing controller 101 into analog image data signals utilizing the gamma reference voltages (GMA1~GMA10) input from the DC to DC converter 177 so as to supply the analog image data signals to the data lines (DL1 to DLj).

The backlight unit 145 may provide the display panel 133 with light. To perform the function, the backlight unit 145 may include a plurality of light source arrays LA1 to LAk as illustrated in FIG. 3.

The respective light source arrays LA1 to LAk may include a plurality of light sources LED. The plurality of light sources LED included in one light source array may be connected in series with each other.

The light source LED may be a light-emitting diode package that includes at least one light-emitting diode. In an exemplary embodiment, for instance, one light-emitting diode package may include a red light-emitting diode generating and emitting red light, a green light-emitting diode generating and emitting green light, and a blue light-emitting diode generating and emitting blue light. The light-emitting diode package may produce white light by combining (or mixing) three colors. In another exemplary embodiment, the light-emitting diode package may include only the blue light-emitting diode among the light-emitting diodes of the three colors and a phosphor may be disposed in a light emitting unit of the blue light-emitting diode so as to convert the generated blue light to white light.

The backlight unit 145 may be any one of a direct-type backlight unit, an edge-type backlight unit, and a corner-type backlight unit. In an exemplary embodiment, the backlight unit 145 illustrated in FIG. 3 may be a direct type.

The dimming signal generating unit 166 may receive the vertical synchronization signal Vsync, the horizontal synchronization signal Hsync, the image data signals DATA, and the clock signal DCLK, which are output from the system. In this case, the dimming signal generating unit 166 may be supplied with the signals through the interface circuit.

The dimming signal generating unit 166 may divide the image data signals of one frame into luminance components and chrominance components, may calculate an average luminance of one frame image by analyzing the luminance components, and may generate a dimming signal based on the calculated average luminance. In one exemplary embodiment, where image data of one frame is a bright image having a high average luminance, a dimming signal with a high value may be generated to increase luminance of the backlight unit 145. In contrast, where image data of one frame is a dark image having a low average luminance, a dimming signal with a low value may be generated to decrease luminance of the backlight unit 145.

Meanwhile, the backlight unit 145 may be controlled by a global dimming method or a local dimming method.

In accordance with the global dimming method, all of the light source arrays LA1 to LAk may be controlled by one dimming signal. In this case, the dimming signal generating unit 166 may generate one dimming signal.

On the other hand, according to the local dimming method, each of the light source arrays LA1 to LAk may be controlled by individual dimming signals. In this case, the dimming signal generating unit 166 may generate dimming signals of which the number is equal to the number of the light source arrays. The respective dimming signals may have the same value or may have different values depending on characteristics of one frame image. For instance, a light source array disposed corresponding to a bright part of one frame image may be driven by a dimming signal with a high value, and a light source array disposed corresponding to a dark part of one frame image may be driven by a dimming signal with a low value.

The backlight controller 158 may control luminance of the backlight unit 145 in accordance with a dimming signal or a plurality of dimming signals supplied from the dimming signal generating unit 166.

Figure 4:
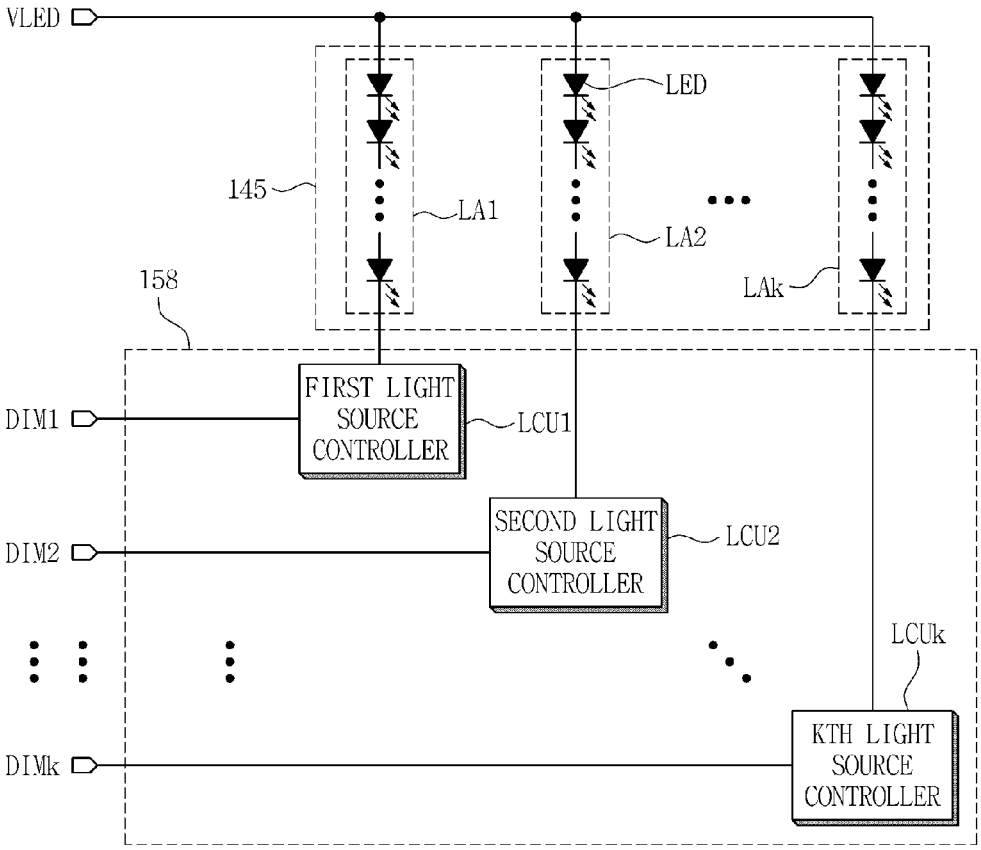
FIG. 4 is a detailed configuration diagram illustrating a backlight controller shown in FIG. 1.

FIG. 4 is a detailed configuration diagram illustrating the backlight controller 158 shown in FIG. 1.

As illustrated in FIG. 4, the backlight controller 158 may include a plurality of light source controllers LCU1 to LCUk. Each light source controller LCU1 to LCUk may be individually connected to the respective light source arrays LA1 to LAk. The respective light source controllers LCU1 to LCUk may control luminance of the respective light source arrays LA1 to LAk according to each dimming signal DIM1 to DIMk.

Meanwhile, as illustrated in FIG. 4, the respective light source arrays LA1 to LAk may receive in common a light driving voltage VLED. The light driving voltage VLED may be applied to an anode of the upper outermost light source LED in the respective light source arrays LA1 to LAk.

Although not illustrated, the light driving voltage VLED may be supplied from a backlight DC to DC converter. The backlight DC to DC converter may increase or decrease a voltage of the driving power VCC input from the system so as to generate signals required to drive the backlight unit 145, and the light driving voltage VLED may be one of the generated signals. The backlight DC to DC converter may be built in the backlight controller 158.

The respective light source controllers LCU1 to LCUk will be described in more detail below. The light source controllers LCU1 to LCUk may have substantially the same configuration, and thus for ease of description, a first light source controller LCU1 will be described representatively.

Figure 5:
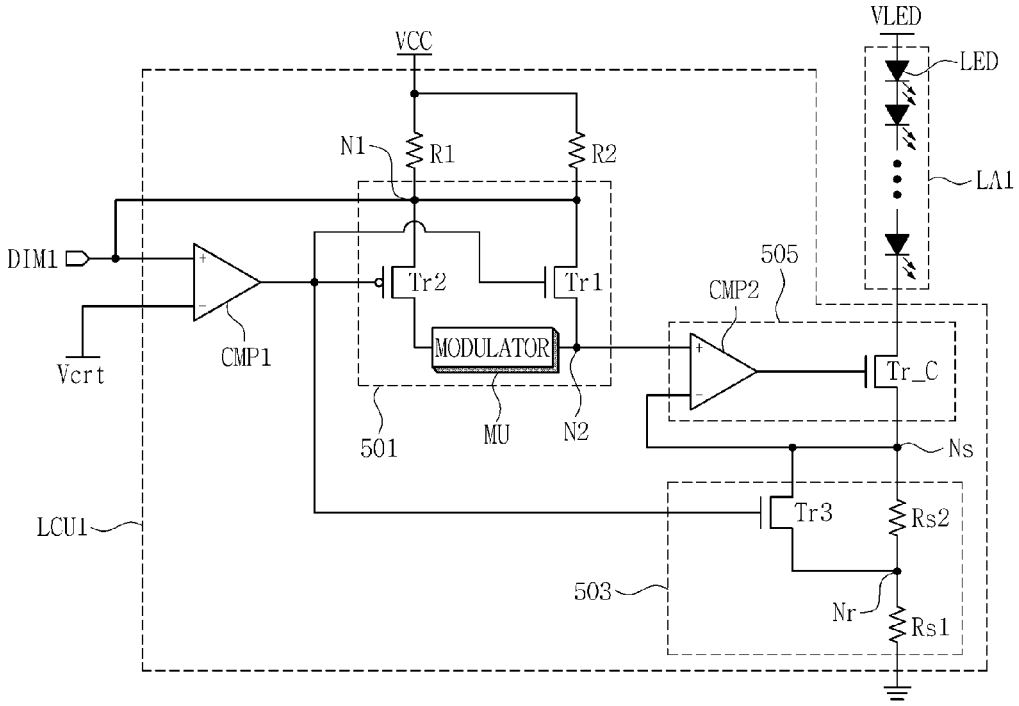
FIG. 5 is a detailed configuration diagram illustrating a first light source controller shown in FIG. 4.

FIG. 5 is a detailed configuration diagram illustrating the first light source controller LCU1 shown in FIG. 4.

As illustrated in FIG. 5, the first light source controller LCU1 may include a first comparator CMP1, a dimming modulating unit 501, a resistor controller 503, and a constant current controller 505.

The First Comparator CMP1

The first comparator CMP1 may be supplied with the dimming signal DIM1 from the dimming signal generating unit 166 and may also externally receive a preset critical value Vcrt. The dimming signal DIM1 may be input to a non-inverting input terminal (+) of the first comparator CMP1 and the critical value Vcrt may be input to an inverting input terminal (−) of the first comparator CMP1. In this case, the critical value Vcrt may be supplied from the backlight DC to DC converter.

The first comparator CMP1 may compare the dimming signal DIM1 with the critical value Vcrt and may generate a comparison signal based on a result of the comparison. For instance, where the dimming signal DIM1 is greater than the critical value Vcrt, the first comparator CMP1 may output a comparison signal that is in a first logic state. In contrast, where the dimming signal DIM1 is less than or equal to the critical value Vcrt, the first comparator CMP1 may output a comparison signal that is in a second logic state. The first and second logic states may be a high and low logic states, respectively, or the first logic state may be the low logic state and the second logic state may be the high logic state.

The first comparator CMP1 may have a hysteresis property. For example, the first comparator CMP1 may be a Schmitt trigger.

The Dimming Modulating Unit 501

The dimming modulating unit 501 may receive the comparison signal output from the first comparator CMP1 and the dimming signal DIM1 output from the dimming signal generating unit 166. The dimming modulating unit 501 may determine a modulation of the dimming signal DIM1 according to the state of the comparison signal. In an exemplary embodiment, where the comparison signal is in the first logic state, the dimming modulating unit 501 may output the dimming signal DIM1 input to itself without a modulation. On the other hand, where the comparison signal is in the second logic state, the dimming modulating unit 501 may modulate the dimming signal DIM1. Accordingly, when the comparison signal is in the first logic state, the dimming signal DIM1 output from the dimming modulating unit 501 may be substantially the same as the dimming signal DIM1 input to the dimming modulating unit 501.

To perform the operation, the dimming modulating unit 501 may include a first switching element Tr1, a second switching element Tr2, and a modulator MU.

The first switching element Tr1 may be controlled in accordance with the comparison signal output from the first comparator CMP1 and may be connected between first and second nodes N1 and N2. The first node N1 may be an output terminal of the dimming signal generating unit 166. The second node N2 may be an output terminal of the modulator MU. When the comparison signal output from the first comparator CMP1 is in the first logic state, the first switching element Tr1 may be turned on in response to the comparison signal in the first logic state. The first switching element Tr1, which is turned on, may output the dimming signal DIM1 that is substantially identical to the dimming signal DIM1 input to the first switching element Tr1 to the second node N2. When the comparison signal output from the first comparator CMP1 is in the second logic state, the first switching element Tr1 may be turned off in response to the comparison signal in the second logic state.

The second switching element Tr2 may be controlled in accordance with the comparison signal output from the first comparator CMP1 and may be connected between the first node N1 and an input terminal of the modulator MU. When the comparison signal output from the first comparator CMP1 is in the second logic state, the second switching element Tr2 may be turned on in response to the comparison signal in the second logic state. The second switching element Tr2, which is turned on, may output the dimming signal DIM1 input to itself to the modulator MU. When the comparison signal output from the first comparator CMP1 is in the first logic state, the second switching element Tr2 may be turned off in response to the comparison signal in the first logic state.

Meanwhile, first and second resistors R1 and R2 may be connected in parallel with each other between the power supply unit included in the system and the first node N1. The driving power output VCC from the power supply unit of the system may be applied to the first node N1 through the first and second resistors R1 and R2.

The Modulator MU

The modulator MU may modulate the dimming signal DIM1 input through the second switching element Tr2 that is turned on, and may output the modulated dimming signal DIM1 to the second node N2. In more detail, the modulator MU may amplify the input dimming signal DIM1. For instance, the modulator MU may be a non-inverting amplifier that outputs the input dimming signal DIM1 by amplifying it 10 times.

The Resistor Controller 503

The resistor controller 503 may adjust a resistance value connected to a sensor node Ns in accordance with the comparison signal output from the first comparator CMP1. The resistor controller 503 may serve as a current sensor that detects a light driving current flowing through the sensor node Ns. In more detail, the resistor controller 503 may detect a current sensing voltage generated by the light driving current.

To perform the function, the resistor controller 503 may include a first sensor resistor Rs1, a second sensor resistor Rs2, and a third switching element Tr3.

The first and second sensor resistors Rs1 and Rs2 may be connected in series between the sensor node Ns and a ground. More than two sensor resistors Rs1 and Rs2 may be provided. The ground may be replaced with a direct current (DC) voltage source.

The third switching element Tr3 may be controlled according to the comparison signal output from the first comparator CMP1 and may be connected between the sensor node Ns and a connecting point Nr which is positioned between the sensor resistors Rs1 and Rs2 and the sensor node Ns. Where the comparison signal output from the first comparator CMP1 is in the first logic state, the third switching element Tr3 may be turned on in response to the comparison signal in the first logic state. The third switching element Tr3, which is turned on, may short circuit the sensor node Ns and the connecting point Nr. Where the comparison signal output from the first comparator CMP1 is in the second logic state, the third switching element Tr3 may be turned off in response to the comparison signal in the second logic state.

When the third switching element Tr3 is turned on as described above, the first sensor resistor Rs1 may be connected to the sensor node Ns. In contrast, when the third switching element Tr3 is turned off, the first and second sensor resistors Rs1 and Rs2 may be connected in series to the sensor node Ns. Accordingly, when the third switching element Tr3 is turned off, a resistor having a higher resistance value is connected to the sensor node Ns.

The second sensor resistor Rs2 may have a higher resistance value than the first sensor resistor Rs1. For instance, the first sensor resistor Rs1 and the second sensor resistor Rs2 may have resistance values in the ratio 1:9.

The resistor controller 503 may include any element that is capable of serving as a current sensor. For example, the resistor controller 503 may have the same structure as a coil or a photocoupler.

The Constant Current Controller 505

The constant current controller 505 may receive the dimming signal DIM1 from the dimming modulating unit 501 and a voltage of the sensor node Ns. The constant current controller 505 may control a magnitude of a light driving current supplied to the light source array LA1 in accordance with the level of the dimming signal DIM1. As the dimming signal DIM1 has a higher level, the light driving current may have a higher magnitude.

To perform the function, the constant current controller 505 may include a second comparator CMP2 and a constant current switching element Tr_C.

The second comparator CMP2 may receive the dimming signal DIM1 from the dimming modulating unit 501 and may also be supplied with a sense voltage from the sensor node Ns. The dimming signal DIM1 may be input to a non-inverting input terminal (+) of the second comparator CMP2 and the sense voltage may be input to an inverting input terminal (−) of the second comparator CMP2. The second comparator CMP2 may compare the dimming signal DIM1 with the sense voltage and may generate a comparison signal based on a result of the comparison. The second comparator CMP2 may control a level of the comparison signal so that the dimming signal DIM1 may be equal to the sense voltage. In more detail, as a current flowing through the sensor node Ns increases, the sense voltage may also increase, and the second comparator CMP2, which detects the increases, may reduce an output (the comparison signal) thereof. In accordance with the reduced comparison signal, the current flowing to the sensor node Ns through the third switching element Tr3 may decrease. As a result, the sense voltage of the sensor node Ns may also be reduced. In contrast, when the current flowing through the sensor node Ns decreases, the sense voltage may also decrease, and the second comparator CMP2, which detects the decreases, may increase the output (the comparison signal) thereof. In accordance with the increased comparison signal, the current flowing to the sensor node Ns through the third switching element Tr3 may increase. As a result, the sense voltage of the sensor node Ns may become higher. Thus, the second comparator CMP2 may adjust the level of the comparison signal so that the sense voltage input to the inverting input terminal (−) may be equal to the dimming signal DIM1 input to the non-inverting input terminal (+). Therefore, the light driving current can be supplied to the light source array LA1, while being uniform in magnitude according to the dimming signal DIM1.

For example, the second comparator CMP2 may be an operational amplifier.

The constant current switching element Tr_C may be controlled according to the comparison signal from the second comparator CMP2 and may be connected between the light source array LA1 and the sensor node Ns. The constant current switching element Tr_C may adjust the magnitude of the light driving current flowing to the light source array LA1 in accordance with the level of the comparison signal applied to a gate electrode of the constant current switching element Tr_C. As the comparison signal from the second comparator CMP2 has a higher level, the light driving current may be increased in magnitude.

Among the first switching element Tr1, the second switching element Tr2, and the third switching element Tr3, the second switching element Tr2 may be a transistor of which a type is different from those of the other switching elements Tr1 and Tr3. In an exemplary embodiment, where the first switching element Tr1 and the third switching element Tr3 may be N-type transistors, the second switching element Tr2 may be a P-type transistor. Conversely, where the first switching element Tr1 and the third switching element Tr3 may be the P-type transistors, the second switching element Tr2 may be the N-type transistor.

The constant current switching element Tr_C may be the N-type or P-type transistor.

Meanwhile, the first to third switching elements Tr1, Tr2, and Tr3 may be transistors that operate in a saturation region, whereas the constant current switching element Tr_C may be a transistor that operates in a linear region.

An operation of the first light source controller LCU1 configured as above will be described below in detail.

Figure 6A:
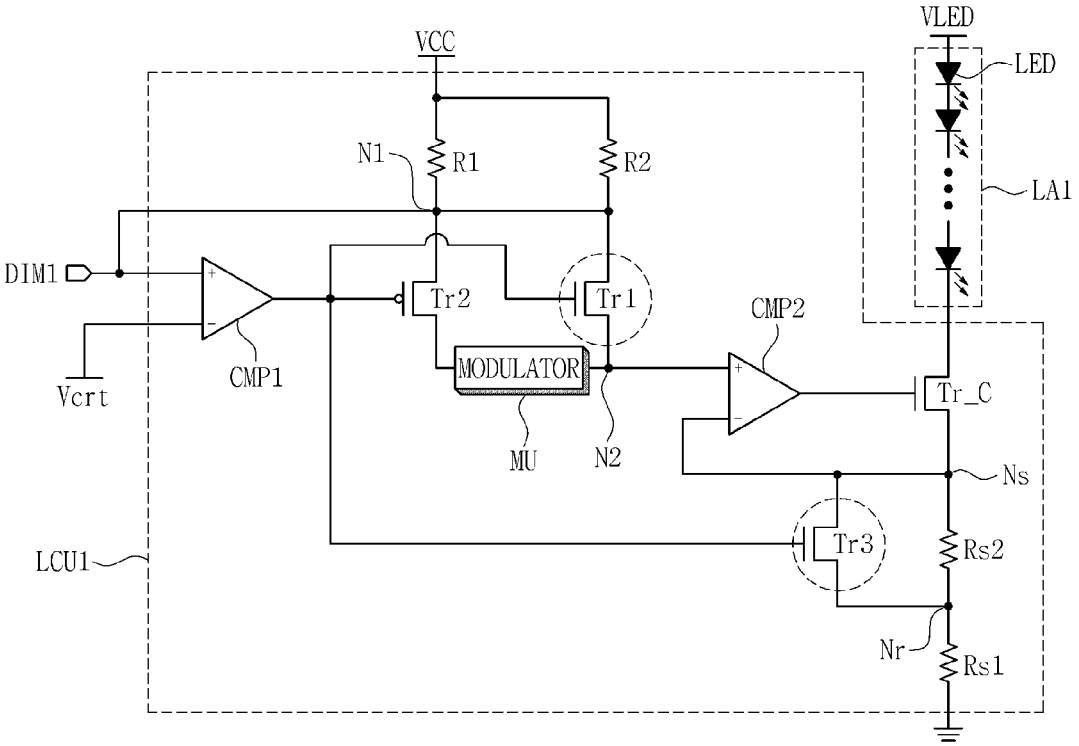
FIG. 6A is a diagram illustrating an operation of a first light source controller when a dimming signal from a dimming signal generating unit has a level greater than a critical value.

FIG. 6A is a diagram illustrating an operation of the first light source controller LCU1 when the dimming signal DIM1 from the dimming signal generating unit 166 has a level greater than the critical value Vcrt.

As illustrated in FIG. 6A, when the dimming signal DIM1 is a DC voltage that is higher than the critical value Vcrt, the first comparator CMP1 may output the comparison signal in the first logic state.

The comparison signal in the first logic state may be supplied to each gate electrode of the first to third switching elements Tr1, Tr2, and Tr3. In this case, where the first logic state is a high logic state, the first and third switching elements Tr1 and Tr3, which fall into the N-type transistor, may be turned on, whereas the second switching element Tr2, which falls into the P-type transistor, may be turned off.

The dimming signal DIM1 may be input to the non-inverting input terminal (+) of the second comparator CMP2 through the first switching element Tr1 that is turned on.

A short circuit may occur between the sensor node Ns and the connecting point Nr by the third switching element Tr3 that is turned on. Accordingly, the first sensor resistor Rs1 may be connected to the sensor node Ns. Consequently, the sense voltage detected by the first sensor resistor Rs1 may be input to the inverting input terminal (−) of the second comparator CMP2.

The second comparator CMP2 may generate the comparison signal based on the dimming signal DIM1 and the sense voltage and may provide the constant current switching element Tr_C with the comparison signal.

The constant current switching element Tr_C may adjust the light driving current according to the comparison signal.

Figure 6B:
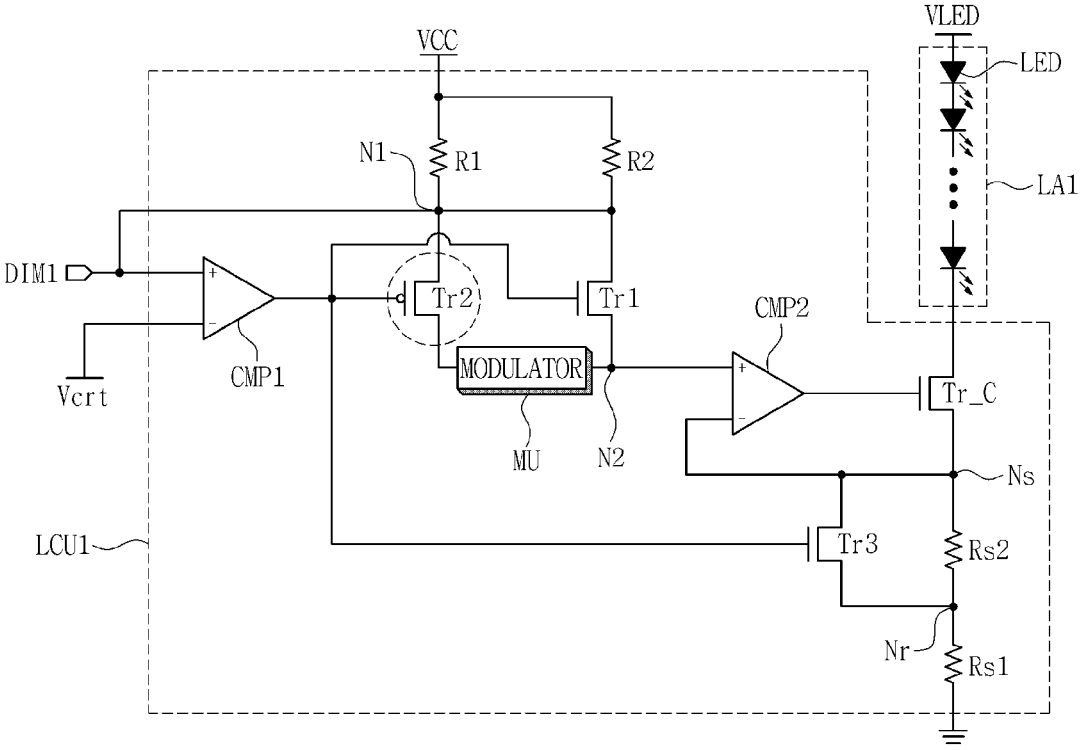
FIG. 6B is a diagram illustrating an operation of a first light source controller when a dimming signal from a dimming signal generating unit has a level less than or equal to a critical value.

FIG. 6B is a diagram illustrating an operation of the first light source controller LCU1 when the dimming signal DIM1 from the dimming signal generating unit 166 has a level less than or equal to the critical value Vcrt.

As illustrated in FIG. 6B, when the dimming signal DIM1 is a DC voltage that is less than or equal to the critical value Vcrt, the first comparator CMP1 may output the comparison signal that is in the second logic state.

The comparison signal in the second logic state may be supplied to each gate electrode of the first to third switching elements Tr1, Tr2, and Tr3. In this case, where the second logic state is a low logic state, the first and third switching elements Tr1 and Tr3, which fall into the N-type transistor, may be turned off, whereas the second switching element Tr2, which falls into the P-type transistor, may be turned on.

The dimming signal DIM1 may be input to the modulator MU through the second switching element Tr2 that is turned on.

The modulator MU may amplify the input dimming signal DIM1 and may output the amplified dimming signal to the non-inverting input terminal (+) of the second comparator CMP2.

The first and second sensor resistors Rs1 and Rs2 may be connected in series between the sensor node Ns and the ground by the third switching element Tr3 that is turned off. Therefore, the sense voltage detected by the first and second sensor resistors Rs1 and Rs2 may be input to the inverting input terminal (−) of the second comparator CMP2.

The second comparator CMP2 may generate the comparison signal based on the dimming signal DIM1 and the sense voltage and may provide the constant current switching element Tr_C with the comparison signal.

The constant current switching element Tr_C may adjust the light driving current according to the comparison signal.

As described above, where the dimming signal DIM1 has a low level, the first light source controller LCU1 may amplify the dimming signal DIM1 utilizing the modulator MU and may increase a resistance value by the amplification rate so as to minimize or effectively prevent increase in the light driving current. Therefore, the constant current switching element Tr_C may be normally operated by the amplified dimming signal DIM1, and since the resistance value of the sensor resistor increases by the amplification rate of the dimming signal DIM1, the light driving current may be normally generated to have a magnitude corresponding to the original dimming signal DIM1 (the dimming signal DIM1 before being amplified).

Figure 7:
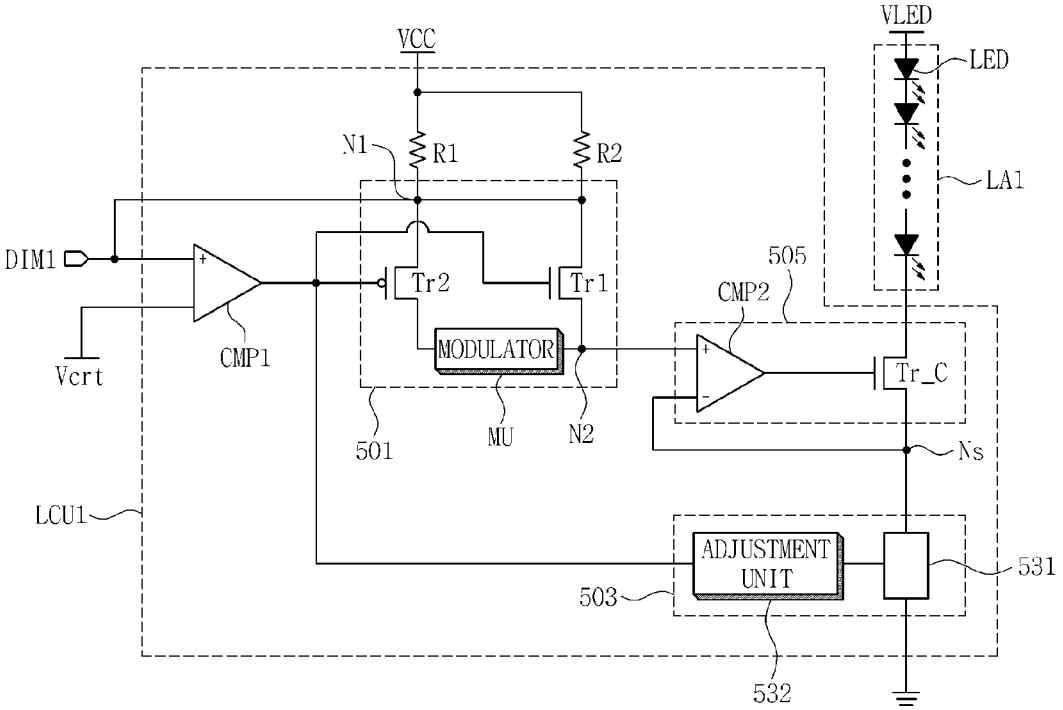
FIG. 7 is another detailed configuration diagram illustrating the first light source controller shown in FIG. 4.

FIG. 7 is another detailed configuration diagram illustrating the first light source controller LCU1 shown in FIG. 4.

As illustrated in FIG. 7, the resistor controller 503 may include a variable resistor 531 and an adjustment unit 532.

The variable resistor 531 may be connected between the sensor node Ns and the ground. The variable resistor 531 may be a digital variable resistor that varies by a digital control signal.

The adjustment unit 532 may adjust a resistance value of the variable resistor 531 in accordance with the comparison signal output from the first comparator CMP1. In an exemplary embodiment, where the comparison signal output from the first comparator CMP1 is in the first logic state, the adjustment unit 532 may output a first digital control signal. On the other hand, where the comparison signal output from the first comparator CMP1 is in the second logic state, the adjustment unit 532 may output a second digital control signal.

The variable resistor 531 may have a resistance value equivalent to the first sensor resistor Rs1 by the first digital control signal. On the other hand, the variable resistor 531 may have a resistance value equivalent to the sum of the first and second sensor resistors Rs1 and Rs2 by the second digital control signal.

FIG. 7 shows the first comparator CMP1, the second comparator CMP2, the first switching element Tr1, the second switching element Tr2, the third switching element Tr3, the constant current switching element Tr_C, the modulator MU, the first resistor R1, the second resistor R2, and the light source array LA1, which are the same as illustrated in FIG. 5. Thus, descriptions thereof will not be repeated below.

Meanwhile, the dimming signal DIM1 from the dimming signal generating unit 166 may be a type of an analog DC voltage as described above, or may be provided in a digital pulse type. In other words, the dimming signal generating unit 166 may provide the dimming signal DIM1 in a pulse type utilizing the pulse width modulator included therein.

Figure 8:
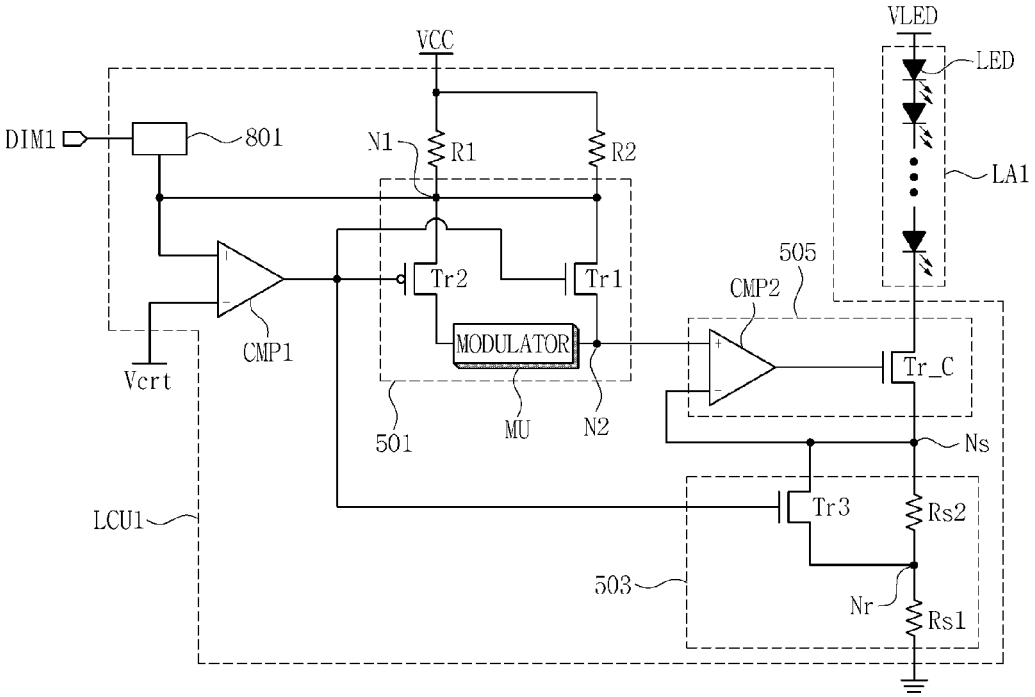
FIG. 8 is a diagram illustrating a configuration of a first light source controller where a dimming signal from a dimming signal generating unit is a pulse type.

FIG. 8 is a diagram illustrating a configuration of the first light source controller LCU1 where the dimming signal DIM1 from the dimming signal generating unit 166 is a pulse type.

Where the dimming signal DIM1 is provided in a pulse type, as illustrated in FIG. 8, the first light source controller LCU1 may further include a signal converter 801 configured to convert the pulse-type dimming signal DIM1 to the analog DC voltage type. For instance, the signal converter 801 may be a digital to analog converter or a RC filter.

Meanwhile, the signal converter 801 may be disposed outside the first light source controller LCU1. The signal converter 801 may also be disposed in the dimming signal generating unit 166.

FIG. 8 shows the first comparator CMP1, the second comparator CMP2, the first switching element Tr1, the second switching element Tr2, the third switching element Tr3, the constant current switching element Tr_C, the modulator MU, the first resistor R1, the second resistor R2, and the light source array LA1, which are the same as illustrated in FIG. 5. Thus, descriptions thereof will not be repeated below.

The first light source controller LCU1 illustrated in FIG. 7 may also include the signal converter 801.

From the foregoing, it will be appreciated that various exemplary embodiments of the invention have been described herein for purposes of illustration, and that various modifications may be made without departing from the scope and spirit of the disclosure. Accordingly, the various exemplary embodiments disclosed herein are not intended to limit the scope of the invention, and the true scope and spirit of the invention is indicated by the following claims, and equivalents thereof.

What is claimed is:

1. A display device, comprising:

at least one light source array configured to provide a display panel with light;

a dimming signal generating unit configured to receive an image data signal and generate a dimming signal;

a first comparator configured to receive the dimming signal output from the dimming signal generating unit and a preset critical value and generate a comparison signal;

a dimming modulating unit configured to receive the comparison signal output from the first comparator and the dimming signal output from the dimming signal generating unit and modulate the dimming signal;

a constant current controller configured to receive the dimming signal output from the dimming modulating unit and a voltage from a sensor node, and to control a light driving current allowing the light source array to drive; and a resistor controller configured to change resistors connected to the sensor node by the comparison signal output from the first comparator.

2. The display device according to claim 1, wherein the dimming modulating unit comprises:

a modulator including an output terminal connected to the constant current controller;

a first switching element controlled according to the comparison signal output from the first comparator and connected between an output terminal of the dimming signal generating unit and the output terminal of the modulator; and a second switching element controlled according to the comparison signal output from the first comparator and connected between the output terminal of the dimming signal generating unit and an input terminal of the modulator.

3. The display device according to claim 2, wherein when the comparison signal output from the first comparator is in a first logic state, the first switching element outputs a substantially the same signal as the dimming signal to the output terminal of the modulator; and when the comparison signal output from the first comparator is in a second logic state, the second switching element outputs a substantially the same signal as the dimming signal to the input terminal of the modulator.

4. The display device according to claim 2, wherein the modulator is used as an amplifier that amplifies the dimming signal input to the modulator through the second switching element.

5. The display device according to claim 2, further comprising first and second resistors connected in parallel between a driving power and the output terminal of the dimming signal generating unit.

6. The display device according to claim 1, wherein the resistor controller comprises:

sensor resistors connected in series between the sensor node and a ground; and a switching element controlled according to the comparison signal output from the first comparator and connected between the sensor node and any one of connecting points which are positioned among the sensor resistors.

7. The display device according to claim 6, wherein when the comparison signal output from the first comparator is in the first logic state, the switching element short circuits the sensor node and the connecting points.

8. The display device according to claim 6, wherein the sensor resistors comprise at least two resistors having different resistance values.

9. The display device according to claim 1, wherein the resistor controller comprises:

a variable resistor connected between the sensor node and the ground; and an adjustment unit configured to adjust a resistance value of the variable resistor according to the comparison signal output from the first comparator.

10. The display device according to claim 9, wherein the variable resistor is a digital variable resistor.

11. The display device according to claim 1, wherein the constant current controller comprises:

a second comparator configured to receive the dimming signal output from the dimming modulating unit and a sense voltage of the sensor node and generate a comparison signal; and a constant current switching element controlled according to the comparison signal output from the second comparator and connected between the light source array and the sensor node.

12. The display device according to claim 1, wherein the dimming signal generating unit comprises:

a pulse width modulator configured to externally receive an image data signal and generate a pulse width modulation signal; and a filter unit configured to receive the pulse width modulation signal from the pulse width modulator and generate a dimming signal so as to provide the first comparator with the dimming signal.

13. The display device according to claim 1, wherein the light source array comprises at least one light emitting element.

* * * * *